US007682133B1

(12) United States Patent
Liang

(10) Patent No.: US 7,682,133 B1
(45) Date of Patent: Mar. 23, 2010

(54) COOLING CIRCUIT FOR A LARGE HIGHLY TWISTED AND TAPERED ROTOR BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 590 days.

(21) Appl. No.: 11/732,161

(22) Filed: Apr. 3, 2007

(51) Int. Cl.
*F01D 5/18* (2006.01)

(52) U.S. Cl. ..... 416/97 R

(58) Field of Classification Search ..... 416/97 R, 416/92, 90 R

See application file for complete search history.

(56) References Cited

U.S. PATENT DOCUMENTS 3,220,697 A * 11/1965 Smuland et al. ..... 416/96 R
5,779,447 A 7/1998 Tomita et al.
5,967,752 A 10/1999 Lee et al.
5,971,708 A 10/1999 Lee
6,152,695 A 11/2000 Fukue et al.
6,254,346 B1 7/2001 Fukuno et al.
6,910,864 B2 6/2005 Tomberg
6,997,679 B2 2/2006 Beddard et al.

* cited by examiner

*Primary Examiner*—Richard Edgar
(74) *Attorney, Agent, or Firm*—John Ryznic

(57) ABSTRACT

A large turbine blade having a large amount of taper and twist, the blade having a internal cooling circuit that includes an axial flow serpentine flow passage in the lower span and a plurality of radial flow channels in the upper span such that the cooling air flow is always passing toward the blade tip. During blade rotation, the cooling air is forced upward and the pressure increases from the centrifugal force to allow for a lower cooling air supply pressure. The axial flow serpentine flow passage includes a series of forward and aft flowing axial channels that extend from the leading edge to the trailing edge such that the cooling air flow in a back and forth direction. The cooling air from the axial flow channels passes into the plurality of radial flow channels formed by radial extending ribs, and then out through blade tip cooling holes. The axial flow channels are formed by axial extending ribs that provide chordwise sectional strength to prevent the blade from untwisting.

9 Claims, 2 Drawing Sheets

COOLING CIRCUIT FOR A LARGE HIGHLY TWISTED AND TAPERED ROTOR BLADE

BACKGROUND OF THE INVENTION

1. Field of the Invention

The present invention relates generally to fluid reaction surfaces, and more specifically to a large turbine airfoil with a cooling circuits.

2. Description of the Related Art Including Information Disclosed Under 37 CFR 1.97 and 1.98

In a gas turbine engine such as an industrial gas turbine engine, a turbine section includes a plurality of rotor blades that react with the hot gas flow passing through the turbine to produce mechanical work by rotating the rotor shaft. In an industrial gas turbine, four stages of rotor blades and stator vanes are used to extract the energy from the flow. As the inlet temperature to the turbine increases, the size of the fourth stage rotor blade also increases because the flow into the fourth stage has higher energy than previous lower temperature engines. These fourth stage rotor blades can be over 30 inches from platform to blade tip, and also have very large taper and twist in order to react with the flow.

With the higher gas flow temperature exposed to the fourth stage blade, internal air cooling is required in order to increase the life of the rotor blade. However, prior art methods of casting turbine blades having internal cooling circuits are not practical with these larger blades. Radial holes cannot be drilled into the large highly twisted and tapered blade because of the large amount of twist from the blade attachment to the tip. A straight hole cannot be placed within the blade. Reduction of available airfoil cross section area for drilling radial holes is a function of the blade twist. Higher airfoil twist yields a lower available cross sectional area for drilling radial cooling holes. Cooling of the large, highly twisted blade by this manufacturing process will not achieve the optimum blade cooling effectiveness. FIG. 1 shows a profile view of a Prior Art large rotor blade with radial cooling holes drilled into the blade.

It is therefore an object of the present invention to provide for a large turbine blade that is highly tapered and twisted with an internal cooling circuit that can be cast into the blade.

Another object of the present invention is to provide for a large turbine blade that is highly tapered and twisted with an internal cooling circuit that will give the blade a very high airfoil chordwise sectional strength to prevent airfoil un-twisting.

Another object of the present invention is to provide for a large turbine blade that is highly tapered and twisted with an internal cooling circuit that will yield a lower and more uniform blade sectional mass average temperature at lower blade span height to improve blade creep life capability.

Another object of the present invention is to provide for a large turbine blade that is highly tapered and twisted with an internal cooling circuit that will provide cooler blade leading and trailing edge corners to enhance the blade high cycle fatigue (HCF) capability.

Another object of the present invention is to provide for a large turbine blade that is highly tapered and twisted with an internal cooling circuit that will allow for the rotation of the blade to provide a centrifugal pumping effect so that a lower cooling air supply pressure is required, resulting in lower leakage flow around the blade attachment and cooler cooling air supply temperature.

BRIEF SUMMARY OF THE INVENTION

The turbine blade of the present invention is directed to a large airfoil having a high amount of taper and twist such that prior art methods of forming the cooling passages are not adequate. The turbine blade includes a lower span with axial flow serpentine cooling flow channels in which a series of channels each extending in the blade chordwise direction by alternating from forward to aft directional flow provides cooling for the lower span. At the upper span of the blade near to the blade tip, a row of radial flow channels in parallel direct the cooling air form the lower span axial flow serpentine passages upward and into the tip of the blade. The radial flow channels would be located in the airfoil where the taper and thin walls would not allow for the serpentine flow channels. The axial serpentine flow passage is formed by horizontal ribs. The upper span radial flow channels are formed by radial ribs. Trip strips are used in all of the channels to promote heat transfer to the cooling air. The cooling circuit can be easily cast into a turbine blade using prior art casting process and provide for a turbine blade with axial flow cooling air that will provide the blade with a lower and more uniform blade sectional mass average temperature at lower blade span height to improve blade creep life capability, a cooler blade leading and trailing edge corners to enhance the blade high cycle fatigue capability, allow for the rotation of the blade to provide a centrifugal pumping effect so that a lower cooling air supply pressure is required, and give the blade a very high airfoil chordwise sectional strength to prevent airfoil un-twisting.

DETAILED DESCRIPTION OF THE INVENTION

Figure 1:
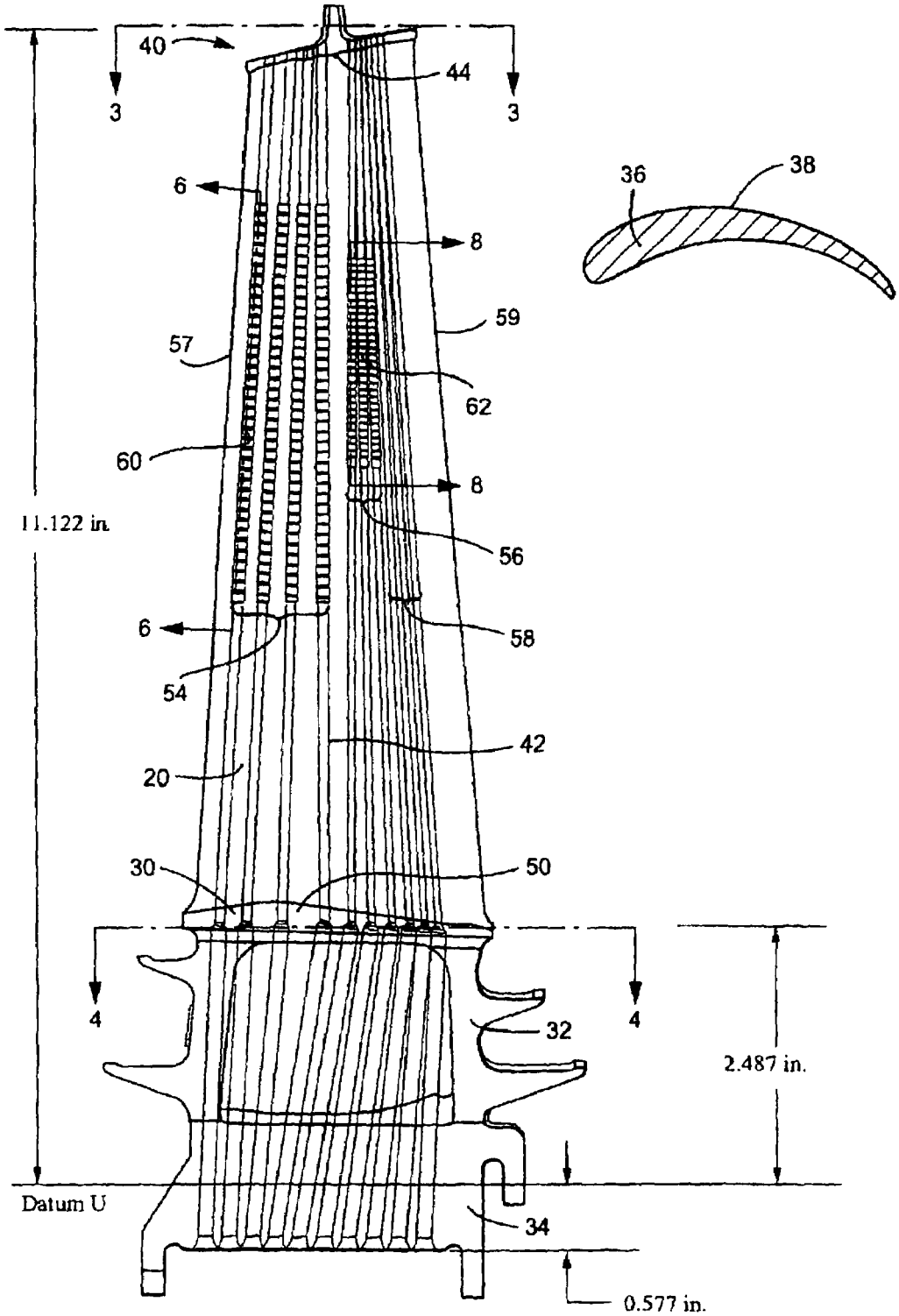
Fig. 1 Prior Art
FIG. 1 shows a prior art large turbine blade with radial drilled cooling holes.
Figure 2:
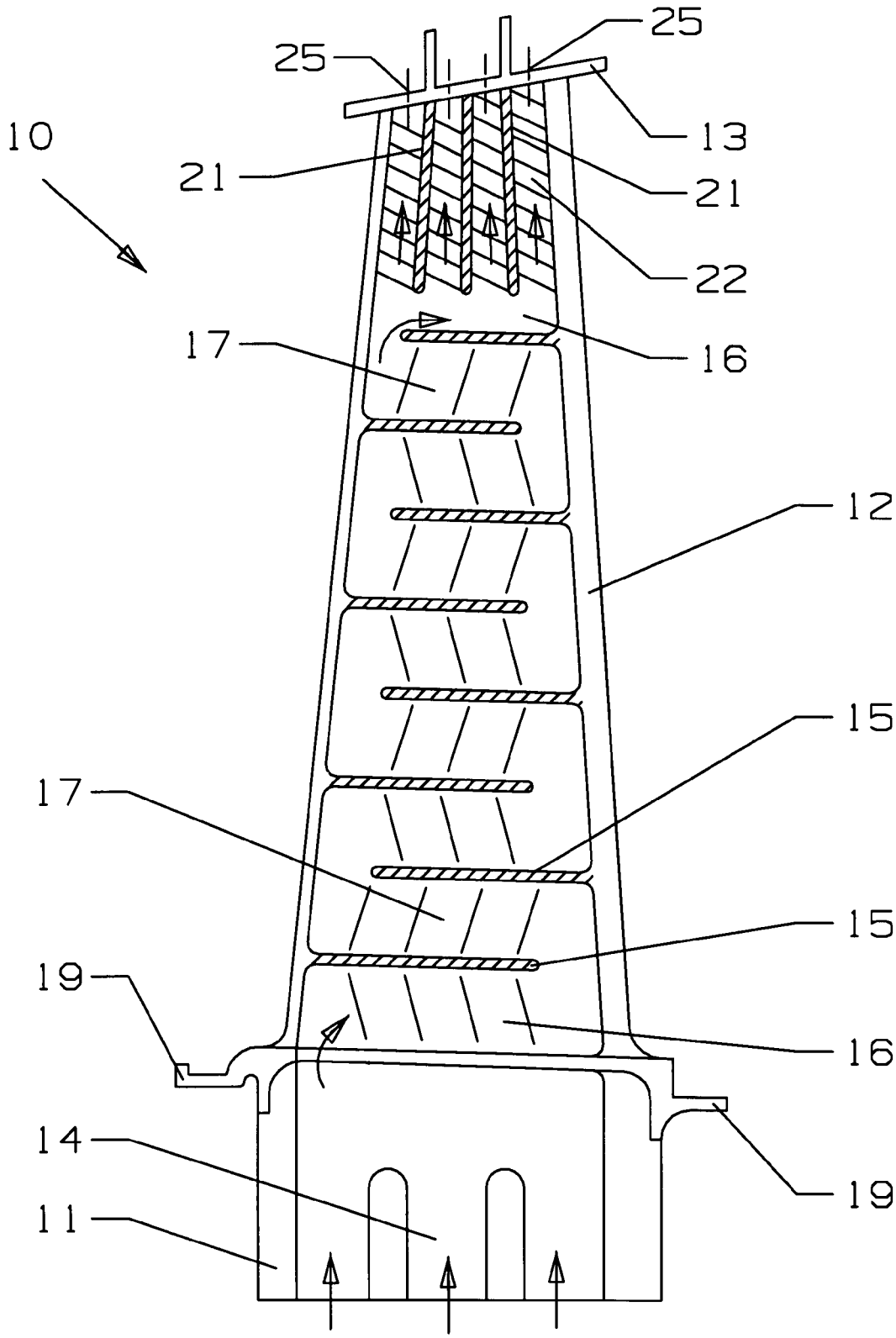
FIG. 2 shows the large rotor blade of the present invention with the internal cooling passages.

The present invention is a large turbine rotor blade that has a large taper and twist due to the length. The blade is from about 30 inches or more in length from blade platform to blade tip. FIG. 1 shows a cross section view of the pressure side for the large turbine blade with the cooling circuit of the present invention. the turbine blade 10 includes a blade attachment 11 with cooling air supply passages 14 that are connected to an external source of pressurized cooling air (external to the blade), an airfoil portion 12 that extends from the attachment 11 and the platforms 19, and a blade tip 13. In the lower span of the blade, where the taper and twist are not too pronounced and the thickness of the airfoil will allow it, an axial flow serpentine flow cooling circuit is formed that includes ribs 15 extending from the leading edge side of the blade and ribs 16 extending from the trailing edge side of the blade. These ribs 15 formed aft flowing channels 16 and forward flowing channels 17. A series of the aft flowing and forward flowing channels are arranged to form a serpentine flow circuit extending from the blade attachment to an upper span of the blade as seen in FIG. 2.

The spacing between axial ribs 15 can be changed for a particular blade in order to tailor the airfoil external heat load by means of varying the channel height (the distance between ribs). The channel height for each individual flow channel in a blade can be different to change the cooling flow performance in the blade spanwise direction. Also, the channel height for a given axial flow channel can be varied in the blade chordwise direction to change the cooling flow mass flux which will alter the cooling capability and metal temperature along the flow path.

At an upper span of the blade, the axial flow serpentine flow circuit ends and discharges the cooling air into a plurality of radial flow channels 22 that are formed between the leading and trailing edges and separated by radial extending ribs 21. Blade tip exit cooling holes 25 discharge cooling air form the radial channels 22 out from the blade tip for cooling the tip 13. Trip strips are provided in the axial and radial flow channels to promote heat transfer from the metal to the cooling air.

Cooling air supplied to the passages 14 in the blade attachment flows into the axial flow serpentine flow circuit and passes in a back and forth direction and upward toward the blade tip. Unlike some prior art serpentine flow cooling circuits in which the cooling air is directed upward toward the blade tip and then directed downward toward the blade attachment, the cooling air in the present invention passes only in the upward direction toward the tip. In this prior art, the cooling air would flow back toward the blade attachment and bring the extra heat picked up as the cooling air passes through the up and down serpentine flow circuit. In the axial flow serpentine flow cooling circuit of the present invention, hot cooling air is not returned toward the blade attachment to provide further cooling.

The cooling channel for the present invention axial flow serpentine flow cooling circuit is inline or at a small angle with the engine centerline. Cooling air flows axially perpendicular to the airfoil span height. This is different from the prior art serpentine flow circuit in which the serpentine channel is perpendicular to the engine centerline and the cooling air flows radial inward and outward along the blade span.

The axial flow serpentine flow cooling circuit of the present invention yields a lower and more uniform blade sectional mass average temperature at lower blade span height which improves blade creep life capability, especially creep at lower blade span.

The cooling air increases in temperature in the axial serpentine flow cooling channel as it flows outward toward the tip and induces hotter sectional mass average temperature at upper blade span. The pull stress at the blade upper span is low and the allowable blade metal temperature is high. The horizontal extending ribs 15 and 16 also provides for a very high airfoil chordwise sectional strength to prevent untwist of the airfoil during operation.

Because the axial flow serpentine flow circuit of the present invention is started at the blade attachment section, cooler blade leading and trailing edge corners result which enhances the blade high cycle fatigue capability.

Because the axial flow serpentine flow circuit of the present invention flows always in the upward direction, a centrifugal pumping effect occurs due to the rotation of the blade during operation. The cooling air is forced upward through the cooling circuit toward the blade tip, increasing the pressure of the cooling air. Because of the centrifugal pumping effect, a lower cooling air supply pressure is required. A lower cooling air supply pressure results in lower leakage flow of the cooling air around the blade attachment and cooler cooling air supply temperature because less work is used to compress the cooling supply air.

As the cooling air flows toward the blade leading and trailing edges, it impinges onto the airfoil leading and trailing corners, and therefore creates a very high rate of internal heat transfer coefficient. As the cooling air turns in each leading and trailing edge turn, it changes momentum which results in increase of heat transfer coefficient. The combination effects create the high cooling for the serpentine turns at blade leading and trailing edges.

I claim the following:

1. A turbine blade comprising:

A blade attachment with a cooling supply channel;

An airfoil having an upper span and a lower span;

A blade tip having a plurality of tip cooling holes to discharge cooling air;

An axial flow serpentine flow cooling passage formed in the lower span and connected to the cooling supply channel in the blade attachment, the axial flow serpentine flow cooling passage formed from a series of alternating forward and aft flowing channels such that the cooling air does not flow back toward the blade attachment; and, A plurality of radial flow channels in the upper span connected to the axial flow serpentine flow cooling passage and the plurality of tip cooling holes such that cooling air flows from the axial flow serpentine flow passage, through the radial channels, and through the blade tip cooling holes.

2. The turbine blade of claim 1, and further comprising:

The blade is a large blade with a high amount of taper and twist; and,

The radial flow channels are formed in the upper span where the taper and twist allows for radial flow channels.

3. The turbine blade of claim 1, and further comprising:

The axial flow serpentine flow channels are formed by chordwise extending ribs that provide for a high airfoil chordwise sectional strength to prevent airfoil un-twist.

4. The turbine blade of claim 3, and further comprising:

The chordwise extending ribs alternate from leading edge and trailing edge extending ribs.

5. The turbine blade of claim 1, and further comprising:

The axial flow serpentine flow channels provide for impingement cooling of the leading and trailing edge corners of the blade as the cooling air turns.

6. The turbine blade of claim 1, and further comprising:

Trips strips are positioned along the channels in the axial flow and radial flow channels to promote heat transfer.

7. The turbine blade of claim 1, and further comprising:

A height of the axial flow channels in the blade are varied such that the blade metal temperature along the flow path is regulated.

8. The turbine blade of claim 1, and further comprising:

The axial flow serpentine flow channels extend substantially in the blade chordwise direction.

9. The turbine blade of claim 1, and further comprising:

The axial flow serpentine flow channels extend from the leading edge to the trailing edge of the blade.

* * * * *